US011291283B2

(12) United States Patent
Rhett, Jr.

(10) Patent No.: US 11,291,283 B2
(45) Date of Patent: Apr. 5, 2022

(54) HEATED STORAGE DEVICE

(71) Applicant: Richard Glenn Rhett, Jr., Chattanooga, TN (US)

(72) Inventor: Richard Glenn Rhett, Jr., Chattanooga, TN (US)

( * ) Notice: Subject to any disclaimer, the term of this patent is extended or adjusted under 35 U.S.C. 154(b) by 183 days.

(21) Appl. No.: 16/115,980

(22) Filed: Aug. 29, 2018

(65) Prior Publication Data

US 2019/0059544 A1 Feb. 28, 2019

Related U.S. Application Data

(60) Provisional application No. 62/551,469, filed on Aug. 29, 2017.

(51) Int. Cl.

| | |
|---|---|
| ***A45C 15/00*** | (2006.01) |
| ***B65D 81/18*** | (2006.01) |
| ***A45C 3/00*** | (2006.01) |
| ***H05B 3/34*** | (2006.01) |
| ***B65D 81/38*** | (2006.01) |
| ***A47G 9/08*** | (2006.01) |
| ***A45C 7/00*** | (2006.01) |

(52) U.S. Cl.

CPC ..... *A45C 15/00* (2013.01); *A45C 3/001* (2013.01); *A45C 7/0095* (2013.01); *A47G 9/086* (2013.01); *B65D 81/18* (2013.01); *B65D 81/3897* (2013.01); *H05B 3/34* (2013.01); *H05B 2203/004* (2013.01)

(58) Field of Classification Search

CPC ..... H05B 2203/003; H05B 2203/017; H05B 2203/036; H05B 3/342; H05B 2203/013; H05B 2203/014; H05B 3/36; H05B 2203/004; H05B 2203/016; H05B 3/34; H05B 3/56; H05B 3/565; H05B 2203/005; H05B 2203/02; H05B 2203/029; H05B 2203/011; H05B 2203/021; H05B 3/0014; H05B 3/145; H05B 3/146; H05B 3/30; H05B 3/345; H05B 3/347; H05B 3/686; A45C 15/00; A45C 3/001; A45C 3/004; A45C 3/12; A45C 7/0095; B65D 81/18; B65D 81/3897

USPC ..... 219/211, 528, 529, 549, 212, 385, 217, 219/527, 162, 201, 202, 209, 213, 489, 219/509, 526, 541, 543, 544, 545

See application file for complete search history.

(56) References Cited

U.S. PATENT DOCUMENTS

| | | | | |
|---|---|---|---|---|
| 2,850,810 | A | 9/1958 | Lyons et al. | |
| 3,380,087 | A * | 4/1968 | Petty ..... | H05B 3/342 219/217 |
| 3,905,125 | A | 9/1975 | Hubner | |
| 4,572,364 | A | 2/1986 | Jordan | |
| 5,528,840 | A | 6/1996 | Pajak et al. | |

(Continued)

*Primary Examiner* — Ibrahime A Abraham
*Assistant Examiner* — Chris Q Liu
(74) *Attorney, Agent, or Firm* — Dunlap Bennett & Ludwig, PLLC; Anna L. Kinney

(57) ABSTRACT

A portable, lightweight, insulated, and heated storage device is provided. The heated storage device is movable between a closed condition adapted to maintain stored items therein at a predetermined temperature and an open condition for externally radiating heat. In one embodiment, the heated storage device may be a heating sack adapted to unfurl from the closed condition storing a sleeping bag or the like to the open condition as a flat, heated blanket, externally radiating heat.

10 Claims, 4 Drawing Sheets

(56) References Cited

U.S. PATENT DOCUMENTS

| | | | | |
|---|---|---|---|---|
| 5,642,572 | A * | 7/1997 | Manning | D06F 58/14 34/621 |
| 5,986,243 | A * | 11/1999 | Campf | A41D 13/0051 219/211 |
| 6,111,233 | A * | 8/2000 | Rock | H05B 3/342 219/211 |
| 6,541,744 | B2 | 4/2003 | Von Arx et al. | |
| 7,777,156 | B2 | 8/2010 | Rock et al. | |
| 7,783,361 | B2 | 8/2010 | Docherty et al. | |
| 8,001,803 | B2 | 8/2011 | Kanagaki | |
| 8,079,502 | B2 * | 12/2011 | Montgomery | A45C 7/0063 224/627 |
| 8,715,210 | B2 | 5/2014 | Orlando | |
| 9,511,921 | B2 | 12/2016 | Crowe et al. | |
| 2004/0085694 | A1 * | 5/2004 | Germagian | H02M 7/003 361/90 |
| 2005/0127056 | A1 | 6/2005 | Petkov et al. | |
| 2005/0167412 | A1 | 8/2005 | Anson et al. | |
| 2006/0207898 | A1 * | 9/2006 | Cheng | A63B 60/60 206/315.1 |
| 2006/0283205 | A1 | 12/2006 | Carriere | |
| 2008/0283513 | A1 * | 11/2008 | Ferguson, III | H05B 3/36 219/217 |
| 2009/0032516 | A1 | 2/2009 | Reasor | |
| 2009/0114633 | A1 * | 5/2009 | Naylor | H05B 1/0236 219/213 |
| 2012/0234247 | A1 * | 9/2012 | Graves | A01K 1/0158 119/28.5 |
| 2012/0255941 | A1 | 10/2012 | Skarzynski | |
| 2016/0135517 | A1 * | 5/2016 | Silverberg | A41D 13/005 2/93 |
| 2017/0035189 | A1 * | 2/2017 | Sosa | A47G 9/086 |

* cited by examiner

HEATED STORAGE DEVICE

CROSS-REFERENCE TO RELATED APPLICATION

This application claims the benefit of priority of U.S. provisional application No. 62/551,469, filed 29 Aug. 2017, the contents of which are herein incorporated by reference.

BACKGROUND OF THE INVENTION

The current invention relates to devices for outdoor activities and more particularly, to a portable, lightweight, insulated, and heated storage device for heating item secured within a closed condition, the storage device movable between the closed condition and an open condition for providing radiant heat to the user.

Being cold while camping is very uncomfortable. A cold sleeping bag or cold clothing can take up to an hour to heat, meaning the user is cold until their body heat can warm up the sleeping bag or clothes. Furthermore, after the sleeping bag or clothing has been warmed, the user is the sole source of heat for maintaining a comfortable temperature as sleeping bag, like clothing, only helps contain heat. As evidenced by the fact that after several hours of sleeping, the user is likely to wake up cold because their body cannot produce enough heat to overcome the heat lost through their sleeping bag system. Resulting in possible discomfort, restlessness, loss of sleep, and hypothermia.

Stuff sacks are commonplace camping accessories since they are good for storing items, but stuff sacks do not generate or radiate heat much less retain heat using insulation. Heating pads, on the other hand, do generate heat, but do not store items, are typically powered by a wall outlet not typically available to campers, and are generally heavy and bulky, limiting portability. Current devices for heating articles are often not portable, but rather only heat items temporarily, and have insufficient storage capability.

As can be seen, there is a need for a portable, lightweight, insulated, and heated storage device for heating internally stored items and for providing external radiant heat.

SUMMARY OF THE INVENTION

In one aspect of the present invention, a heated storage device includes a plurality of layers, providing: an exterior layer having a first shape; an interior layer having a shape generally coextensive with the first shape; and a heating element layer sandwiched between the exterior and interior layers; and a detachable fastener provided along a periphery of the first shape for moving the plurality of layers between a flat open condition and a closed condition defining an enclosure.

In another aspect of the present invention, the heated storage device includes a plurality of layers, providing: an exterior layer having a conjoined oval shape, wherein the exterior layer made from flexible, durable and waterproof material; an interior layer having a shape generally coextensive with the conjoined oval shape; a heating element layer sandwiched between the exterior and interior layers; and an insulation layer between the heating element layer and each of the exterior the interior layers, respectively; a detachable fastener provided along a periphery of the conjoined oval shape for moving the plurality of layers between a flat open condition and a closed condition defining an enclosure, wherein the heating element layer forms a furled position in the closed condition; a portable power source adapted to electrically connect to the heating element layer; a battery pocket provided along the exterior layer, wherein the battery pocket is dimensioned to receive the heating element layer; a wiring harness for electrically interconnecting the heating element layer and the power source received in the battery pocket; the wiring harness generally coplanar with the heating element layer in the open condition; and two pairs of female connectors, each pair of female connectors spaced apart along a length of each longitudinal edge of the periphery.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a portable, lightweight, insulated, and heated storage device for effectively heating stored items and/or providing radiant heat to the user when cold. The heated storage device is movable between a closed condition adapted to maintain stored items therein at a predetermined temperature and an open condition for externally radiating heat. In one embodiment, the heated storage device may be heating sack adapted to unfurl from the closed condition storing a sleeping bag or the like to the open condition as a flat, heated blanket, externally radiating heat.

Referring to FIGS. 1 through 9, the present invention may include a heated storage device 100 for maintaining a preselected temperature of items stored therein, such as, but not limited to sleeping bags or clothing, wherein the storage device 100 is movable between such a closed condition and an open condition, providing portable externally radiating heat for a user.

It should be understood by those skilled in the art that the use of directional terms such as exterior, interior, outer and the like are used in relation to the illustrative embodiments as they are depicted in the figures, the exterior direction (or outer) being outward of FIGS. 1, 2, and 6-9.

Figure 4:
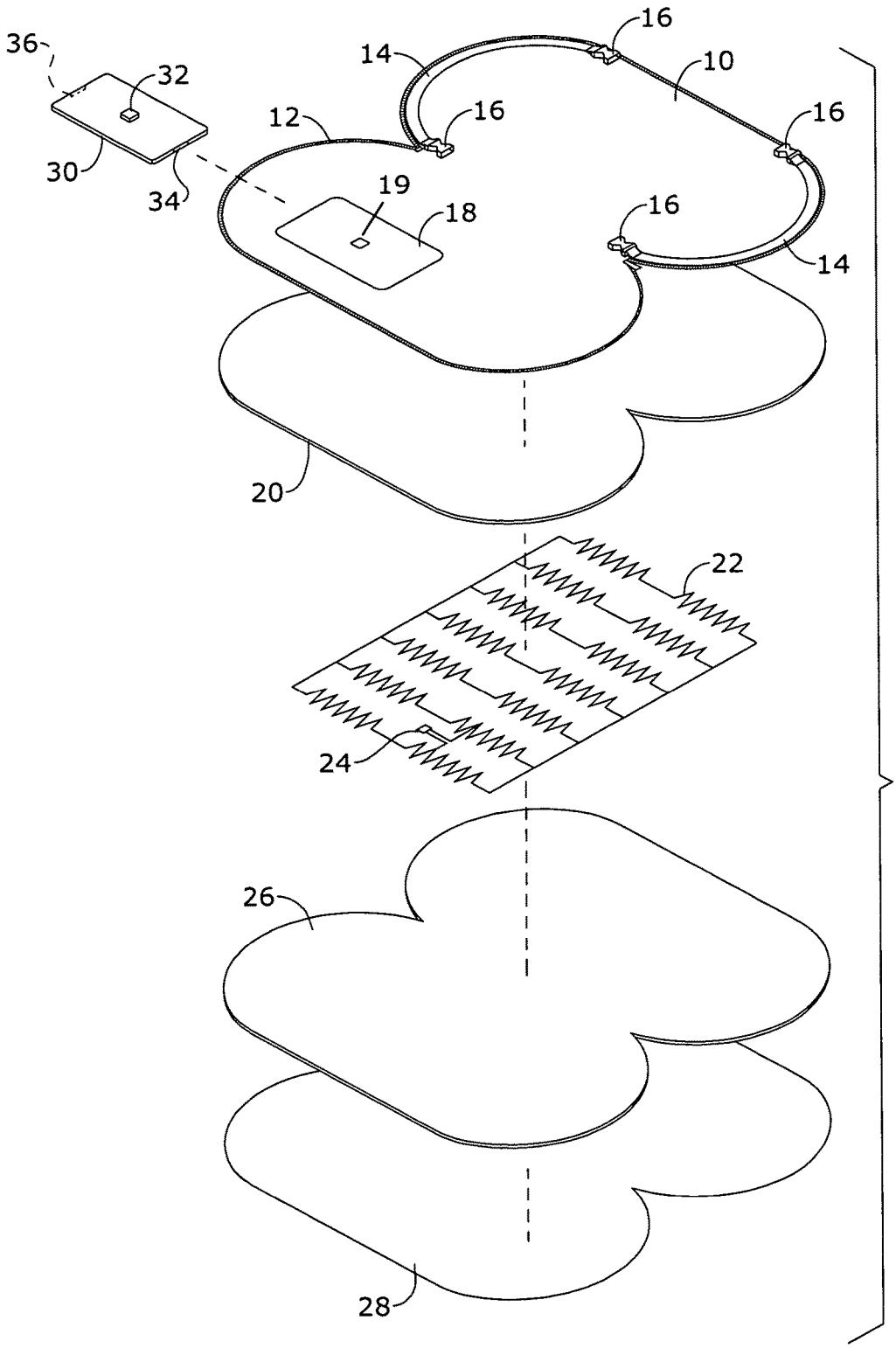
FIG. 4 is an exploded perspective view of a plurality of layers of an exemplary embodiment of the present invention.
Figure 5:
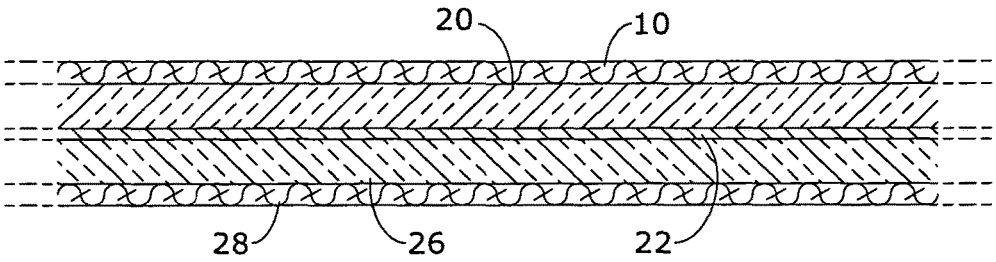
FIG. 5 is a detail section view of an exemplary embodiment of the present invention, taken along line 5-5 in FIG. 3.
Figure 6:
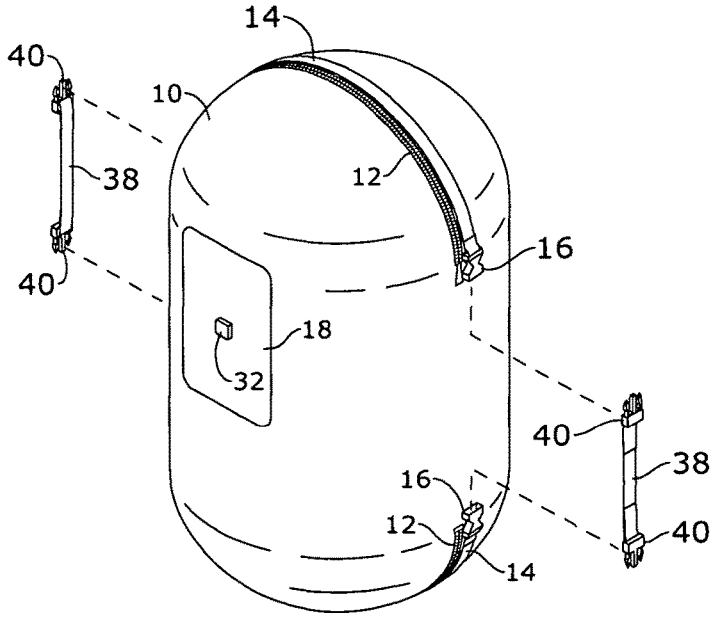
FIG. 6 is a perspective view of an exemplary embodiment of the present invention, illustrating an attachment of compression straps 38.

The heated storage device 100 may provide heating and insulation properties through a plurality of layers including, but not limited to, an exterior layer 10, an exterior insulator layer 20, a heating element 22, an interior insulator layer 26, and an interior layer 28, as illustrated in FIGS. 4 and 5. The plurality of layers may be joined together by conventional methods, such as sewn seams or the like.

Figure 3:
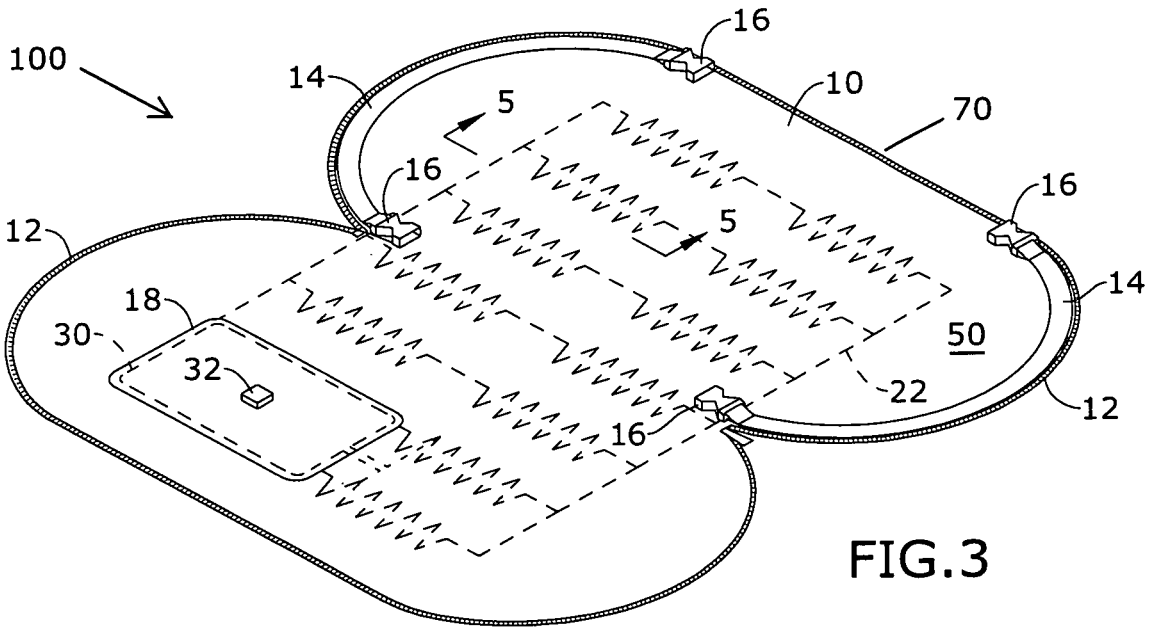
FIG. 3 is a perspective view of an exemplary embodiment of the present invention, shown in an open position, laid flat.

The exterior layer 10 may be flexible, durable, waterproof material forming a conjoined oval shape in the open condition, as illustrated in FIG. 3. Such material may be synthetic, woven, or a combination of both—e.g., nylon, polyester, cotton, or other suitable blended fabrics. The insulating layers 20 and 26 may be made of any natural or synthetic insulation materials adapted to improve the thermal efficiency of the heated storage device 100 in the closed condition. The exterior insulator layer 20, the interior insulator layer 26, and the interior layer 28 may have a coextensive conjoined oval shape, while the heating element 22 may have a square pattern, a rectangular pattern, or any other suitable pattern.

Figure 1:
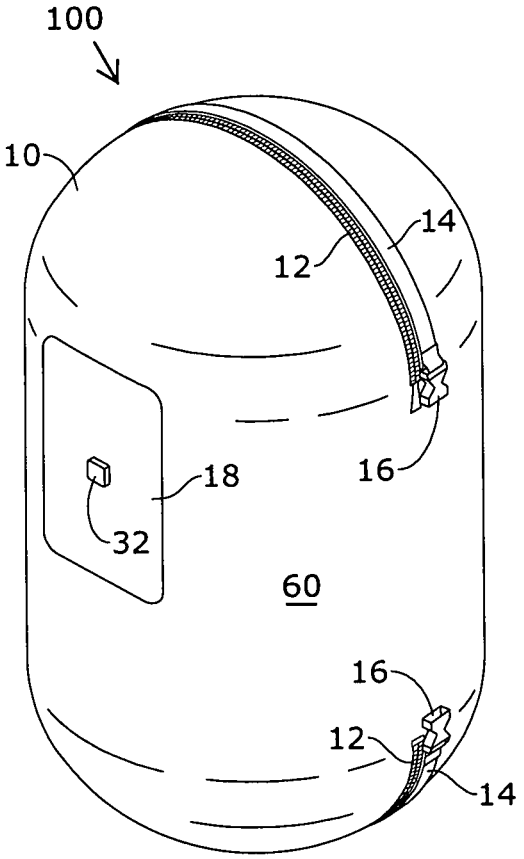
FIG. 1 is a first perspective view of an exemplary embodiment of the present invention, shown in a closed position.
Figure 2:
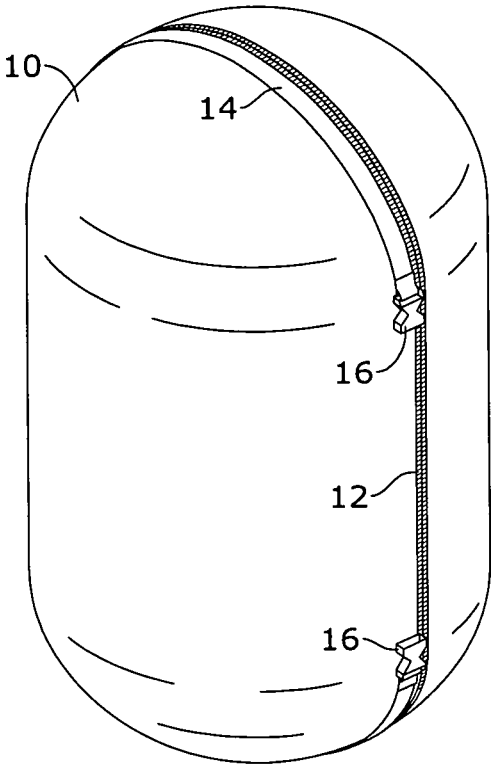
FIG. 2 is a second perspective view, rotated 180 degrees about a longitudinal axis relative to FIG. 1, of an exemplary embodiment of the present invention, shown in the closed position.

Also shown in FIG. 3, along a periphery of the conjoined oval shape may be a detachable fastener 12, such as a zipper, buttons, snaps, buckles, or any suitable joining fasteners. Being that the conjoined oval shape provides two oval portions that are mirror images of each other in the open condition, operatively engaging the detachable fastener 12 moves the exterior layer 10, and so the remaining joined layers of the plurality of layers from the open condition to the closed condition, as illustrated in FIGS. 1 and 2. In the closed condition the interior layer 28 is capable of forming an enclosure encompassing a myriad of items therein.

Along each of the two arcuate ends of a first oval portion 50 (of the two mirror-image oval portions in the open condition, see FIG. 3) of an outer surface 60 of the exterior layer 10 may be an attachment element 14. Each attachment element 14 may terminate in female connectors 16, such as buckles, so that in the closed condition there are two pairs of spaced apart female connectors 16 (shown in FIGS. 1 and 2, respectively). In one embodiment, the female connectors 16 on each pair are spaced apart by a length of a longitudinal edge 70 (the generally straight portion of the periphery, as shown in FIG. 3). The attachment element 14 provides reinforcement along the arcuate portions of the oval portions as well as support for the female connectors 16.

Figure 7:
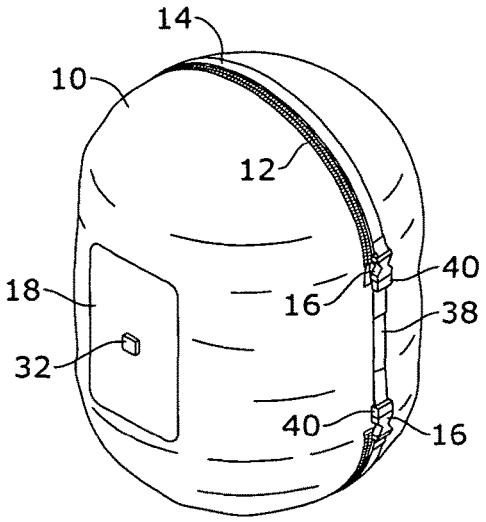
FIG. 7 is a perspective view of an exemplary embodiment of the present invention, illustrating a compressed condition.
Figure 8:
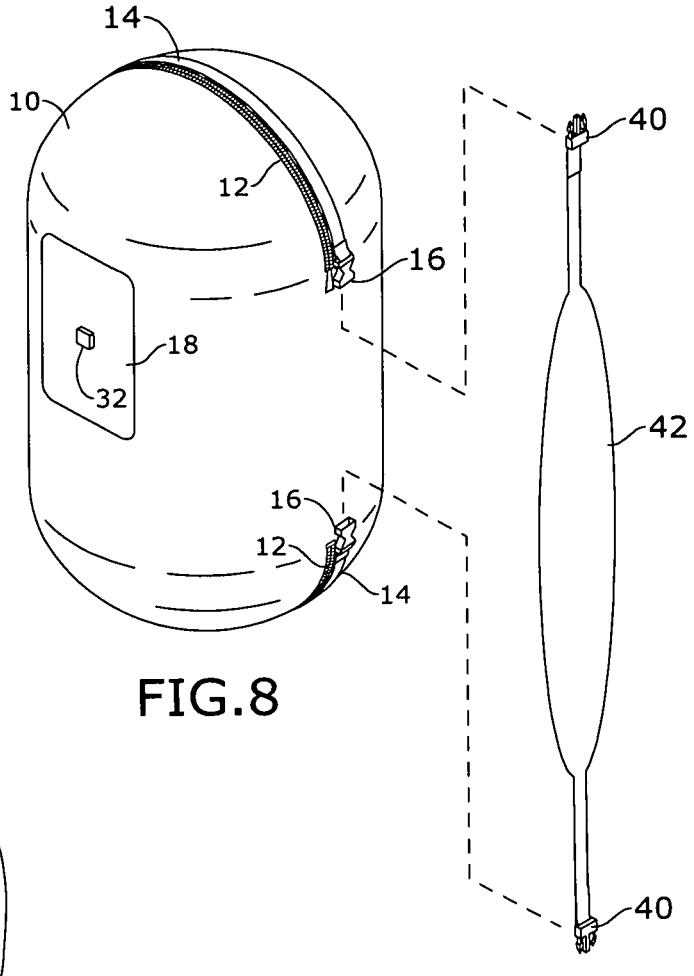
FIG. 8 is a perspective view of an exemplary embodiment of the present invention, illustrating an attachment of a carrying strap 42.
Figure 9:
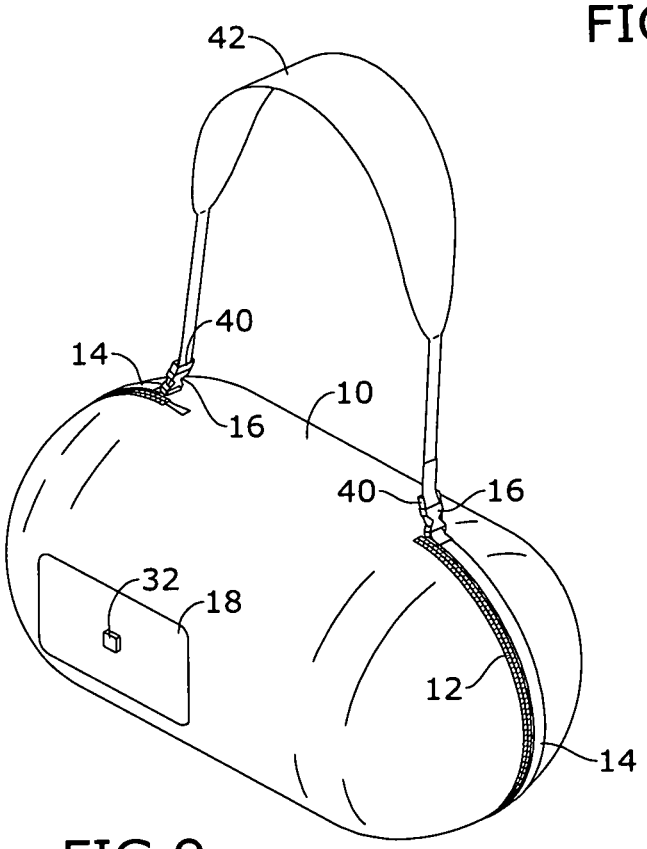
FIG. 9 is a perspective view of an exemplary embodiment of the present invention, with the carrying strap 42 attached.

The present invention may also include a pair of compression straps 38 and a carrying strap 42, each strap (38 or 42) terminates in opposing male connectors 40 so as the removably connect to the spaced apart female connectors 16, as illustrated in FIGS. 6 and 7 and FIGS. 8 and 9, respectively. The pair of compression straps 38 are dimensioned and adapted to allow for compression and reduced size of the heated storage device 100 in a closed, compressed condition, as illustrated in FIG. 7. In effect, the length of the longitudinal edge 70 is reduced in the compressed condition. The carrying strap 42 is dimensioned and adapted to for a user to utilize as a shoulder strap or as a handle to manipulate the heated storage device 100.

The heating element 22 may be formed from material adapted to radiate heat and take a planar position in the open condition and a furled position in the closed condition. For example, the heating element 22 may be a planar sheet (in the open condition) of heat-dissipating electrical wiring, or any other suitable heat source. The heating element 22 is coupled to a portable power source 30, such as a rechargeable battery, by way of a battery wiring harness 24. In the open condition the battery wiring harness 24 is generally coplanar with the planar heating element 22.

The exterior layer 10 may provide a battery pocket (or pouch) 18 that extends along the outer surface 60 of the exterior layer 10. In other embodiments, the battery pocket 18 may be provided in the interior layer 28 or possibly in an insulation layer 20 or 26. The battery pocket 18 is dimensioned to slidably receive the power source 30. The power source 30 may have a flat profile so that its volume or a substantial portion thereof is within an inch of the outer surface 60. The power source 30 may provide a power switch 32, so that when the power source 30 is secured in the battery pocket 18, the power switch 30 may protrude through a hole 19 in the battery pocket 18. The power switch 32 in certain embodiments may be disconnected from the power source 30. Similarly, the power source 30 may provide a heating element connection port 34 to operatively engage the battery wiring harness 24 when the power source 30 is secured in the battery pocket 18. The power source 30 may provide a charging cable port 36 to electrically couple to an external power source, such as an outlet, so as to recharge. The power source may include a timer or timed switch that turns off automatically after a preselected amount of time of usage. The power source 30 may also provides a temperature regulator (not shown) for controlling and maintaining a predetermined temperature of the heating element 22. The temperature regulator may include a thermostat and temperature sensor to allow for temperature control of the heated storage device 100. The temperature regulator may be operatively associated with said timer.

The essence of the heated storage device 100 is the dual condition functionality: providing the closed condition embodying an insulated, heated, stuff sack or bag, wherein the interior layer 28 encompasses and secures items therein while adding heat via the heating element 22 to said items; and providing the open condition embodying a flat heating blanket radiating heat for warming the surrounding space (such as a tent) or specific areas of their body.

A method of making the present invention may include the following. A manufacture may start with a sheet of material for the exterior layer 10, cutting it to the desired pattern on a flat surface. The battery pocket 18 may be joined to the exterior layer 10. Next, one sheet of insulating material is cut to the desired pattern, slightly smaller than the fabric pattern. It is placed directly on top of the cut sheet of material for the exterior layer 10. Next, the heating element 22 may be placed on top of and centered on the first piece of insulating material. A second sheet of insulating material is cut to the same desired pattern as the first, and applied to the top of the heating element 22 so that the heating element 22 is sandwiched between two layers of insulating material. In one embodiment, the number of insulating material layers can vary pending desired performance. Next, a second sheet of material for the interior layer 28 may be cut to the same pattern as the sheet of material for the exterior layer 10. Alternatively, two sheets of material for both the exterior and interior layer 10 and 28 may be cut simultaneously. Likewise, the two insulating layers may be cut simultaneously. The interior layer 28 may be placed on top of the second sheet of insulating material. The two pieces of exterior/interior material around the insulating materials and heating element 22 are enclosed with a sewn seam or using another connection method. The detachable fastener 12 is joined along the periphery of the plurality of layers.

A method of using the present invention may include the following. The heated storage device 100 disclosed above may be provided. While in route, the user can activate the heating element 22 and pre-warm their sleeping bag or clothes enclosed within the closed condition. With a pre-warmed sleeping bag, the user does not have to wait for their body to warm up the sleeping bag; the heated storage device 100 has already warmed the sleeping bag. Once the sleeping bag is deployed, the user can use the heated storage device 100 to continue providing radiant heat via the open condition to the sleeping bag system. The device can also be used to heat clothing articles when they are damp or cold, making them much more comfortable to use.

To heat the items within the closed condition, the switch 32 is pushed to activate the heating element 22 and begin warming the items. After the item is removed, the switch 32 can deactivate the power source 30. In an alternative embodiment, a blue tooth connection is added to the switch 32 to allow for remote control activation or deactivation of the heated storage device 100. In another embodiment, the present invention can produce heated insulated carry bag, backpack, stuff sack, compression bag, warmer, or the like.

It should be understood, of course, that the foregoing relates to exemplary embodiments of the invention and that modifications may be made without departing from the spirit and scope of the invention as set forth in the following claims.

What is claimed is:

1. A heated storage device, comprising:

a plurality of layers, comprising:

an exterior layer having a first shape;

an interior layer substantially coextensive with the exterior layer; and a heating element layer sandwiched between the exterior and interior layers;

a detachable fastener provided along a periphery of the first shape for moving the plurality of layers between a flat open condition and a closed condition defining an enclosure;

a portable power source adapted to electrically connect to the heating element layer comprising a power switch operative to activate the heating element layer;

a battery pocket provided along the exterior layer, wherein the battery pocket is dimensioned to receive the portable power source such that the power switch protrudes through a hole in the exterior layer from the battery pocket;

two pairs of diametrically opposed connectors, each pair of diametrically opposed connectors spaced apart along a length of each longitudinal edge of the periphery; and two compression straps, each compression strap terminating in two opposing connectors, so that when the opposing connectors engage the pairs of diametrically opposed connectors, said length is reduced in a compressed condition.

2. The heated storage device of claim 1, wherein the exterior layer is made from flexible material.

3. The heated storage device of claim 1, further comprising a wiring harness for electrically interconnecting the heating element layer and the power source received in the battery pocket; wherein the wiring harness is substantially coplanar with the heating element layer in the open condition.

4. The heated storage device of claim 1, wherein the heating element layer forms a furled position in the closed condition.

5. The heated storage device of claim 1, further comprising a first insulation layer between the heating element layer and the exterior layer, and a second insulation layer between the heating element layer and the interior layer.

6. The heated storage device of claim 1, further comprising a carrying strap terminating in two opposing connectors for engaging one of the pairs of diametrically opposed connectors.

7. The heated storage device of claim 1, wherein the first shape is a conjoined oval shape.

8. The heated storage device of claim 1, further comprising a charging cable port, wherein said charging cable port is operative to recharge the portable power source.

9. A heated storage device, comprising:

a plurality of layers, comprising:

an exterior layer having a conjoined oval shape, wherein the exterior layer made from flexible material;

an interior layer substantially coextensive with the exterior layer;

a heating element layer sandwiched between the exterior layer and the interior layer; and a first insulation layer between the heating element layer and the exterior layer, and a second insulation layer between the heating element layer and the interior layer;

a detachable fastener provided along a periphery of the conjoined oval shape for moving the plurality of layers between a flat open condition and a closed condition defining an enclosure, wherein the heating element layer forms a furled position in the closed condition;

a portable power source adapted to electrically connect to the heating element layer comprising a power switch operative to activate the heating element layer;

a battery pocket provided along the exterior layer, wherein the battery pocket is dimensioned to receive the portable power source such that the power switch protrudes through a hole in the exterior layer from the battery pocket;

a wiring harness for electrically interconnecting the heating element layer and the power source received in the battery pocket; the wiring harness substantially coplanar with the heating element layer in the open condition;

two pairs of diametrically opposed connectors, each pair of diametrically opposed connectors spaced apart along a length of each longitudinal edge of the periphery; and two compression straps, each compression strap terminating in two opposing connectors, so that when the opposing connectors engage the pairs of diametrically opposed connectors said length is reduced in a compressed condition.

10. The heated storage device of claim 9, further comprising a carrying strap terminating in two opposing connectors for engaging one of the pairs of diametrically opposed connectors.

* * * * *